US008215122B2

(12) United States Patent
Hyun et al.

(10) Patent No.: US 8,215,122 B2
(45) Date of Patent: Jul. 10, 2012

(54) AIR CONDITIONER AND METHOD OF CONTROLLING THE SAME

(75) Inventors: Seung Youp Hyun, Seoul (KR); Deok Huh, Seoul (KR); Gil Bong Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 713 days.

(21) Appl. No.: 12/392,351

(22) Filed: Feb. 25, 2009

(65) Prior Publication Data

US 2009/0211279 A1 Aug. 27, 2009

(30) Foreign Application Priority Data

Feb. 25, 2008 (KR) ..... 10-2008-0016611

(51) Int. Cl.
*F25B 5/02* (2006.01)
*F25B 49/02* (2006.01)

(52) U.S. Cl. ..... 62/200; 62/222; 62/223; 62/224

(58) Field of Classification Search ..... 62/199, 62/200, 222, 223, 224, 225
See application file for complete search history.

(56) References Cited

U.S. PATENT DOCUMENTS 4,766,735 A * 8/1988 Gotou ..... 62/175
7,131,283 B2 * 11/2006 Oh et al. ..... 62/159

FOREIGN PATENT DOCUMENTS

| | | |
|---|---|---|
| GB | 2 194 651 | 3/1988 |
| GB | 2 223 607 | 4/1990 |
| GB | 2 257 244 | 1/1993 |
| WO | WO 01/94857 | 12/2001 |

OTHER PUBLICATIONS

European Search Report dated Jun. 16, 2009.

* cited by examiner

*Primary Examiner* — Marc Norman
(74) *Attorney, Agent, or Firm* — KED & Associates, LLP

(57) ABSTRACT

An air conditioner and a method of controlling the same are provided. The air conditioner may include an outdoor unit, one or more indoor units operably coupled to the outdoor unit, a temperature sensor, a valve driver, and a controller. By monitoring an actual temperature and comparing the actual temperature to a desired temperature, a flow path, of flow direction, and flow capacity flowing to the one or more indoor units to adjust a heating/cooling capacity thereof as appropriate.

9 Claims, 4 Drawing Sheets

AIR CONDITIONER AND METHOD OF CONTROLLING THE SAME

CROSS-REFERENCE TO RELATED APPLICATIONS

This application claims priority under 35 U.S.C. 119 and 35 U.S.C. 365 to Korean Patent Application No. 10-2008-0016611 (filed in Korea on Feb. 25, 2008), which is hereby incorporated by reference in its entirety.

BACKGROUND

1. Field

An air conditioner and a method of controlling an air conditioner are provided.

2. Background

In general, an air conditioner is an apparatus for cooling or heating an interior space of a building. Today, multi air conditioners that cool or heat separate rooms of an indoor space independently are being developed so that the rooms may be heated or cooled more efficiently.

Such multi air conditioners may include at least one outdoor unit provided with an outdoor heat exchanger, and a plurality of indoor units respectively provided with indoor heat exchangers. All of the indoor units may operate simultaneously, or some of the indoor units may operate, to cool or heat respective rooms, while others remain in a standby mode.

BRIEF DESCRIPTION OF THE DRAWINGS

The embodiments will be described in detail with reference to the following drawings in which like reference numerals refer to like elements wherein.

DETAILED DESCRIPTION

Reference will now be made in detail to the embodiments of the present disclosure, examples of which are illustrated in the accompanying drawings.

In the following detailed description of, reference is made to the accompanying drawings that form a part hereof, and in which is shown by way of illustration various embodiments. These drawings and the accompanying description thereof are provided in sufficient detail to enable those skilled in the art to practice these embodiments, and it is understood that other embodiments may be utilized and that logical structural, mechanical, electrical, and chemical changes may be made without departing from the spirit or scope as broadly described herein.

Figure 1:
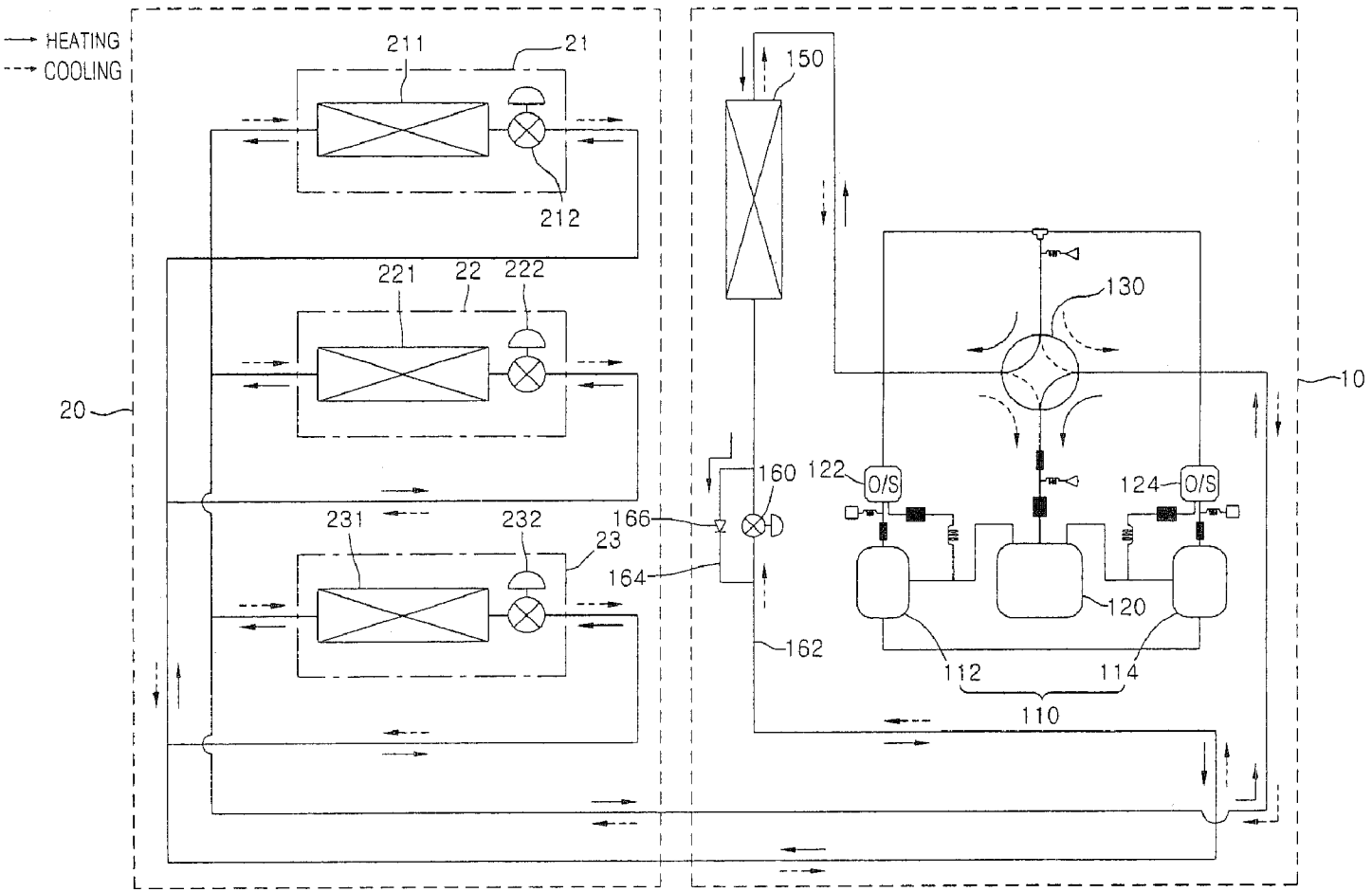
FIG. 1 is a schematic diagram a refrigerant cycle of an air conditioner according to an embodiment as broadly described herein.

FIG. 1 is a schematic diagram a refrigerant cycle of an exemplary air conditioner according to an embodiment as broadly described herein.

Referring to FIG. 1, the exemplary air conditioner may include at least one outdoor unit 10 and at least one indoor unit 20 connected to the outdoor unit 10. For example, the indoor unit 20 may include first, second and third indoor units 21, 22, and 23, as illustrated in FIG. 1. However, the numbers of outdoor units 10 and indoor units 20 may be varied as appropriate. The outdoor unit 10 may include a compressor 110, an outdoor heat exchanger 150, and a four-way valve 130 that changes a refrigerant flow direction according to a heating or cooling operation of the air conditioner. Each of the indoor units 21, 22, and 23 may include indoor heat exchangers 211, 221, and 231, respectively, and indoor linear expansion valves (LEVs) 212, 222, and 232, respectively.

The compressor 110 may include an inverter compressor 112 capable of operating at a variable speed, and a constant speed compressor 114 capable of operating at a constant speed. Thus, in an instance of low load demand, such as, for example, with a small number of indoor units in operation, the inverter compressor 112 may be operated first. If the load is gradually increased to the point at which the load exceeds the capacity of the inverter compressor 112, the constant speed compressor 114 may be operated.

Inlets of the compressors 112 and 114 may be connected to an accumulator 120 to introduce a vapor refrigerant into the compressors 112 and 114. Outlets of the compressors 112 and 114 may be provided with oil separators 122 and 124, respectively, that separate oil from the refrigerant discharged from the compressors 112 and 114. The oil separators 122 and 124 may communicate with intake parts of the compressors 112 and 114.

The compressors 112 and 114 may be connected to the four-way valve 130 to change the flow direction of refrigerant that is discharged from the compressors 112 and 114. Through the four-way valve 130, the refrigerant discharged from the compressors 112 and 114 may be selectively moved to the outdoor heat exchanger 150 or the indoor heat exchangers 211, 221, and 231.

An outdoor linear expansion valve 160 may be provided at a connection pipe 162 that connects the outdoor heat exchanger 150 to the indoor units 21, 22, and 23. With the outdoor linear expansion valve 160 serving as a boundary, a parallel pipe 164 may be provided in parallel with the connection pipe 162. When the outdoor heat exchanger 150 functions as a condenser, the refrigerant may flow to the parallel pipe 164.

The parallel pipe 164 may be provided with a check valve 166 that prevents the flow of refrigerant therethrough when the outdoor heat exchanger 150 functions as an evaporator, and that allows the refrigerant to pass therethrough when the outdoor heat exchanger 150 functions as a condenser.

Hereinafter, the heating and cooling operations of the air conditioner shown in FIG. 1 will be described.

During a cooling operation, refrigerant discharged from the compressors 112 and 114 flows to the outdoor heat exchanger 150 by a passage adjustment through the four-way valve 130. Then, the refrigerant passing through the outdoor heat exchanger 150 is condensed. After that, the refrigerant discharged from the outdoor heat exchanger 150 passes through the check valve 166, and then expands, passing through the indoor linear expansion valves 212, 222, and 232. The expanded refrigerant is evaporated, passing through the indoor heat exchangers 211, 221, and 231, and then is introduced back into the compressors 112 and 114 through the accumulator 120.

During a heating operation, refrigerant discharged from the compressors 112 and 114 flows to the indoor heat exchangers 211, 221, and 231 by a passage adjustment through the four-way valve 130. Then, the refrigerant passing through the indoor heat exchangers 211, 221, and 231 is condensed. After that, the refrigerant discharged from the indoor heat exchangers 211, 221, and 231 expands, passing through the outdoor linear expansion valve 160. The expanded refrigerant is evaporated, passing through the outdoor heat exchanger 150, and then is introduced back into the compressors 112 and 114 through the accumulator 120.

Figure 2:
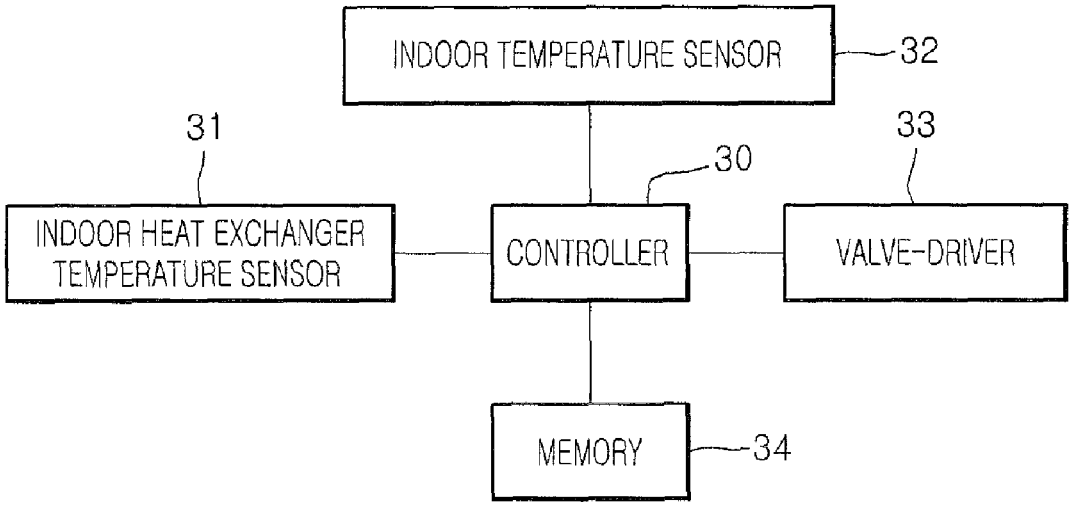
FIG. 2 is a block diagram of an air conditioner control system according to an embodiment as broadly described herein.

FIG. 2 is a block diagram of an air conditioner control system according to an embodiment as broadly described herein.

Referring to FIG. 2, the air conditioner may include an indoor heat exchanger temperature sensor 31 that senses an outlet pipe temperature of an indoor heat exchanger during a heating operation of the air conditioner, an indoor temperature sensor 32 that senses an indoor temperature, a memory 34 that stores a target pipe temperature of the indoor heat exchanger corresponding to a difference between the sensed indoor temperature and a desired indoor temperature, a valve driver 33 that operates the indoor linear expansion valves 212, 222, and 232, and a controller 30 that controls operation of the valve driver 33 to adjust openings of the indoor linear expansion valves 212, 222, and 232 corresponding to the target pipe temperature.

The indoor heat exchanger temperature sensor 31 may include a plurality of temperature sensors that sense outlet temperatures of the indoor heat exchangers 211, 221, and 231 during a heating operation. That is, the indoor heat exchanger temperature sensor 31 senses outlet pipe temperatures of the indoor heat exchangers 211, 221, and 231 functioning as a condenser. In this embodiment, the indoor heat exchanger temperature sensor 31 may be referred to as "a first temperature sensor"

The indoor temperature sensor 32 may include a plurality of temperature sensors that sense temperatures of individual rooms respectively provided with individual indoor units. In this embodiment, the indoor temperature sensor 32 may be referred to as "a second temperature sensor."

The memory 34 stores the value of the target pipe temperature of the indoor heat exchanger corresponding to the difference between the sensed indoor temperature and the desired indoor temperature, for the temperature of each room to reach the desired temperature. That is, the target pipe temperature value is a temperature value including a pipe temperature compensation value corresponding to the difference between the indoor temperature and the desired indoor temperature.

The target pipe temperature value of the indoor heat exchanger may be set, for example, as shown in TABLE 1.

TABLE 1

| dT: Indoor Temperature-Desired Temperature (° C.) | Target Pipe Temperature (° C.) |
|---|---|
| dT > 1 | Mean Pipe Temperature − 4 |
| 1 ≧ dT > 0 | Mean Pipe Temperature − 2 |
| 0 ≧ dT > −1 | Mean Pipe Temperature |
| −1 ≧ dT > −2 | Mean Pipe Temperature + 2 |
| −2 ≧ dT | Mean Pipe Temperature + 4 |

Referring to TABLE 1, the target pipe temperature may be set variably according to the difference between the actual indoor temperature and the desired indoor temperature. The difference range between the actual indoor temperature and the desired indoor temperature, and the variation in the mean pipe temperature depending on the difference range are not limited to TABLE 1. Other combinations may also be appropriate The target pipe temperature may be determined by increasing or decreasing the mean pipe temperature according to the difference between the actual indoor temperature and the desired indoor temperature. The mean pipe temperature is a mean temperature of the outlet pipe temperatures in the respective indoor heat exchangers.

For example, when the actual indoor temperature of a specific room is greater than the desired temperature, decreasing the indoor temperature is advantageous in terms of efficiency. Thus, the target pipe temperature is set to a predetermined temperature lower than the mean pipe temperature. The controller 30 controls the operation of the valve driver 33 in a manner where the outlet pipe temperature of the indoor heat exchanger provided to the specific room reaches the target pipe temperature.

When the actual indoor temperature of the specific room is less than the desired indoor temperature, increasing the indoor temperature is desirable. Thus, the target pipe temperature is set to a predetermined temperature higher than the mean pipe temperature. The controller 30 controls the operation of the valve driver unit 33 in a manner where the outlet pipe temperature of the indoor heat exchanger provided to the specific room reaches the target pipe temperature.

As such, the target pipe temperature may be increased or decreased to the predetermined temperature relative to the mean pipe temperature in order to control the extent of overheat using the indoor linear expansion valves 212, 222, and 232. The extent of the overheat may be varied according to the openings of the indoor linear expansion valves 212, 222, and 232, and the performance of the compressor and the air conditioner may be varied according to the extent of the overheat.

Relationships between the openings of the indoor linear expansion valves 212, 222, and 232 and the indoor temperatures are as follows. When the opening is increased, the flow rate of the refrigerant passing through the heat exchanger is increased, thus increasing the outlet temperature of the indoor heat exchanger. As a result, the indoor temperature is increased.

Thus, the target pipe temperature in this embodiment may be set by determining the mean pipe temperature to control the extent of the overheat, and then by increasing or decreasing the determined mean pipe temperature corresponding to the difference between the actual indoor temperature and the desired indoor temperature. The openings of the indoor linear expansion valves 212, 222, and 232 may be adjusted corresponding to the target pipe temperatures.

Thus, according to this embodiment, the target pipe temperature may be set corresponding to the difference between the actual indoor temperature and the desired indoor temperature, and the opening of the indoor linear expansion valve may be adjusted corresponding to the target pipe temperature, so that the actual temperatures of the respective rooms can reach the desired indoor temperatures.

Figure 3:
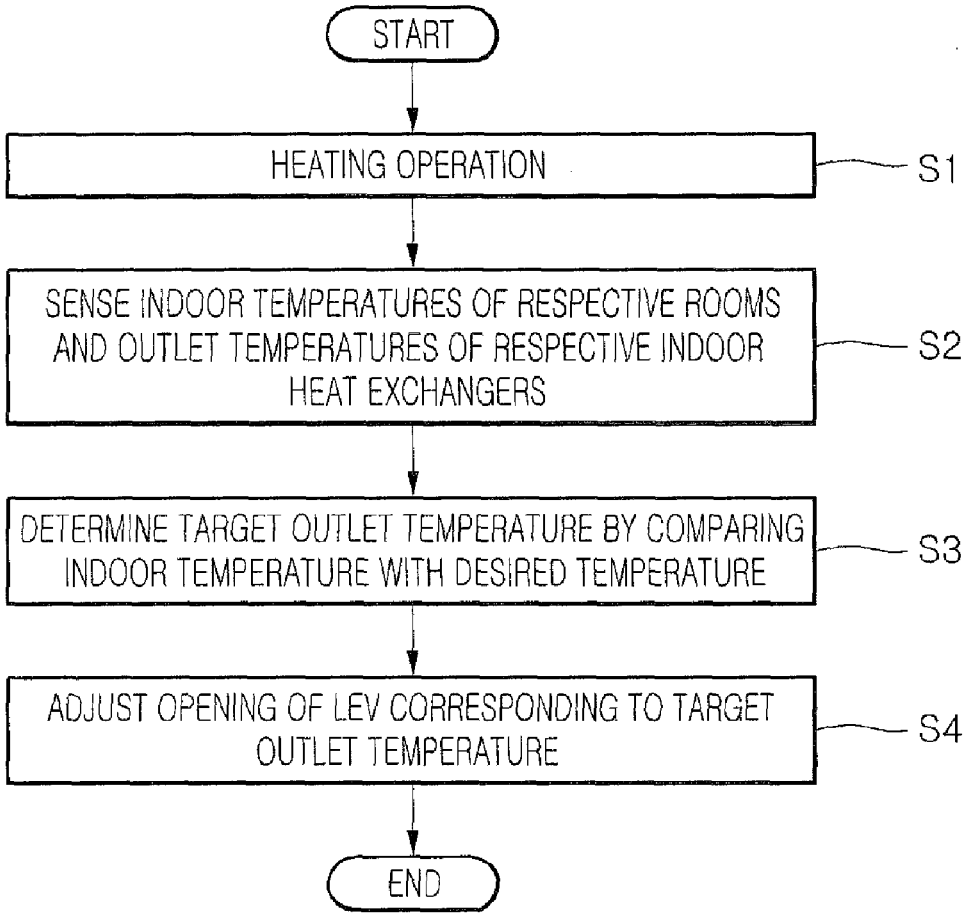
FIG. 3 is a flowchart of a method of controlling an air conditioner according to an embodiment as broadly described herein.

FIG. 3 is a flowchart of a method of controlling an air conditioner according to an embodiment as broadly described herein. FIGS. 4A-4B are graphs illustrating opening variation of indoor linear expansion valves according to pipe temperature variation. In particular, FIG. 4A illustrates pipe temperature variation in indoor heat exchangers of respective rooms, and FIG. 4B illustrates opening variation of the indoor heat exchangers.

Figure 4:
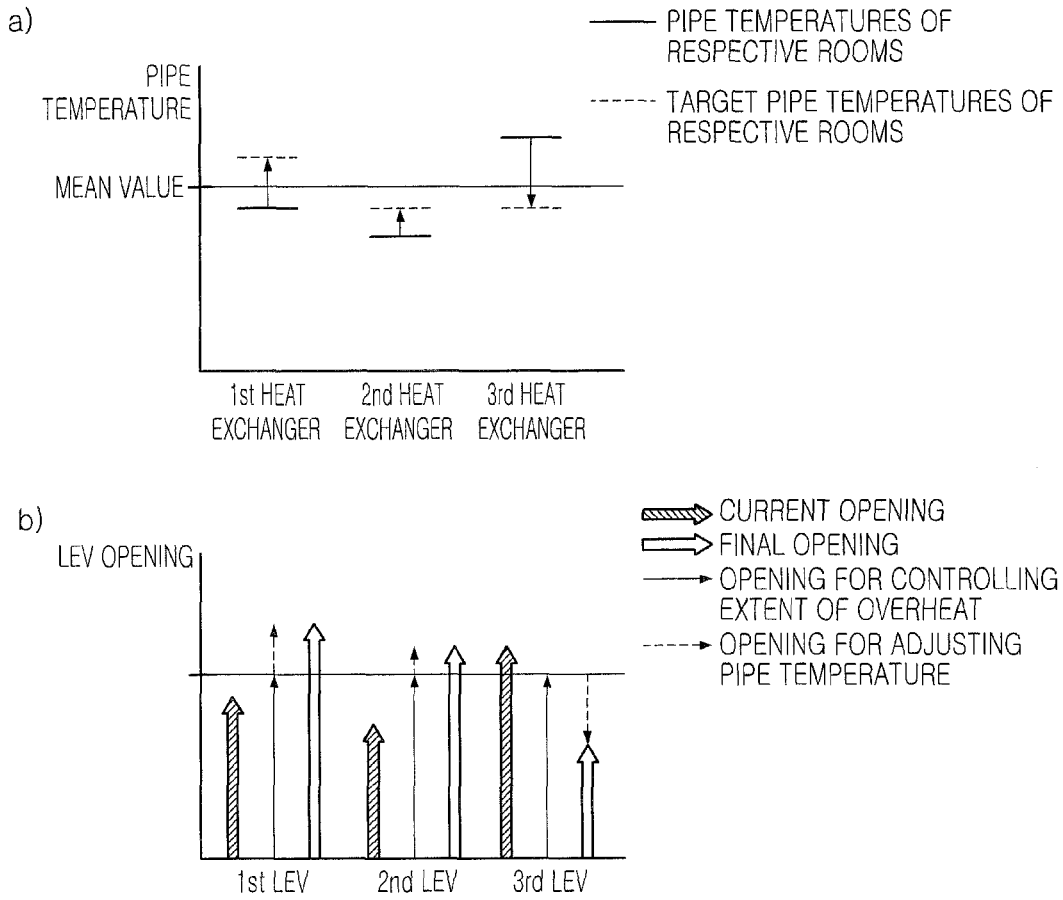
FIGS. 4A-4B are graphs illustrating opening variation of indoor electronic expansion valves according to pipe temperature variation.

Referring to FIGS. 3 and 4, in step S1, heating/cooling operations of a plurality of indoor units may be performed according to users' selections in the respective rooms.

Then, refrigerant discharged from the compressors 112 and 114 may be introduced into the respective indoor heat exchangers 211, 221, and 231 by a passage adjustment of the four-way valve 130. The refrigerant is condensed, passing through the respective indoor heat exchangers 211, 221, and 231.

In step S2, while the air conditioner is in the heating operation, the temperatures of the rooms respectively provided with the indoor units may be sensed by the indoor temperature sensor 32, and the outlet temperatures of the respective indoor heat exchangers 211, 221, and 231 may be sensed by the indoor heat exchanger temperature sensor 31. Then, the mean value of the sensed outlet temperatures of the indoor heat exchangers 211, 221, and 231 may be calculated by the controller 30.

In step S3, at the controller 30, the target pipe temperatures of the respective indoor heat exchangers may be determined corresponding to the differences between the sensed respective actual indoor temperatures and the desired indoor temperatures of the respective rooms set by the user. The values of the target pipe temperatures of the respective indoor heat exchangers may be loaded in the memory 34.

The controller 30 may perform the operation of the valve driver 33 in order that the current temperatures of the indoor heat exchangers reach the respective target pipe temperatures. Then, in step S4, the valve driver 33 may adjust the openings of the respective indoor linear expansion valves 212, 222, and 232.

Referring to FIG. 4A, e.g., at the first and second heat exchangers, the indoor temperatures are lower than the desired temperatures. In these cases, the target pipe temperatures are set higher than the pipe temperatures of the first indoor heat exchanger and the second heat exchanger. Thus, the openings of the first and second indoor linear expansion valves are increased as illustrated in FIG. 4B.

On the other hand, at the third heat exchanger, the indoor temperature is lower than the desired temperature. In this case, the target pipe temperature is set lower than the pipe temperature of the third heat exchanger. Thus, the opening of the third indoor linear expansion valve is decreased as illustrated in FIG. 4B.

According to the embodiments as broadly described herein, the target pipe temperatures of the indoor heat exchangers may be set corresponding to the differences between the indoor temperatures and the desired temperatures, and the openings of the respective indoor linear expansion valves may be independently adjusted corresponding to the target pipe temperatures, so that the temperatures of the respective rooms may accurately reach the desired temperatures.

Embodiments as broadly described herein provide an air conditioner and a method of controlling the same.

In one embodiment, an air conditioner may include an outdoor unit provided with a compressor; at least one indoor unit connected to the outdoor unit and provided with an indoor heat exchanger and an indoor linear expansion valve; a temperature-sensing unit sensing a temperature of a room provided with the indoor unit; a valve-driving unit driving the indoor linear expansion valve; and a control unit comparing the temperature sensed by the temperature-sensing unit with a desired temperature set by a user, determining an amount of opening variation of the indoor linear expansion valve, corresponding to a comparison result, and controlling operation of the valve-driving unit to adjust an opening of the indoor linear expansion valve.

In another embodiment, a method of controlling an air conditioner may include performing a heating operation with a plurality of indoor units; sensing indoor temperatures of rooms provided with the respective indoor units; and determining amounts of opening variation of expansion valves adjusting flow rates of refrigerant in the respective indoor units corresponding to differences between the sensed respective indoor temperatures and desired temperatures of the rooms, so as to adjust openings of the respective expansion valves.

Any reference in this specification to "one embodiment," "an embodiment," "example embodiment," "certain embodiment," "alternative embodiment," etc., means that a particular feature, structure, or characteristic described in connection with the embodiment is included in at least one embodiment as broadly described herein. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

an outdoor unit including a compressor;

at least one indoor unit connected to the outdoor unit, wherein the at least one indoor unit is configured to be connected to a respective interior space to be heated or cooled, wherein each indoor unit comprises:

an indoor heat exchanger;

an indoor linear expansion valve; and a temperature sensor that senses a temperature of its respective interior space;

a valve driver that drives the indoor linear expansion valve of the at least one indoor unit;

a controller that compares a temperature of the interior space, sensed by the temperature sensor, to a selected temperature, that determines an opening amount for the indoor linear expansion valve based on the result of the comparison, and that controls the valve driver to adjust an opening of the linear expansion valve accordingly; and a memory in which a target pipe temperature of the indoor heat exchanger of the at least one indoor unit is stored, wherein the target pipe temperature corresponds to a difference between a current sensed temperature and a set temperature for a respective interior space, and wherein the controller controls operation of the valve driver so that an actual pipe temperature of the indoor heat exchanger of the at least one indoor unit reaches the target pipe temperature.

2. The air conditioner of claim 1, wherein the at least one indoor unit comprises a plurality of indoor units each connected to the outdoor unit, and each configured to be connected to a respective interior space, wherein the controller independently adjusts openings of each indoor linear expansion valve respectively provided with each of the plurality of indoor units based on a comparison of respective sensed temperatures to respective selected temperatures for each of the plurality of interior spaces.

3. The air conditioner of claim 2, wherein the memory stores target pipe temperatures of the respective indoor heat exchangers of the plurality of indoor units, and wherein each target pipe temperature corresponds to a corresponding difference between a current sensed temperature and a set temperature for its respective interior space.

4. The air conditioner of claim 3, further comprising a pipe temperature sensor provided with each of the plurality of indoor heat exchangers to sense a pipe outlet temperature of the respective indoor heat exchanger, wherein the target pipe temperature for each of the plurality of indoor units is obtained by adding or subtracting a temperature value, corresponding to the difference between the set temperature and the current sensed temperature, from a mean value of the sensed pipe outlet temperature for each indoor unit.

5. A method of controlling an air conditioner, the method comprising:

performing a heating or cooling operation with a plurality of indoor units;

sensing indoor temperatures of a plurality of rooms respectively connected to the plurality of indoor units;

determining differences between the sensed indoor temperatures and respective set temperatures of the plurality of rooms, and determining amounts of opening variation of a plurality of expansion valves respectively provided with the plurality of indoor units based on the determined differences;

adjusting openings of the expansion valves corresponding to the determined amounts of opening variation to adjust a flow rate therethrough; and determining target pipe temperatures of a plurality of indoor heat exchangers respectively provided with the plurality of indoor units, comprising:

determining differences between the respective sensed indoor temperatures and the set temperatures of the respective interior spaces; and adjusting openings of the respective expansion valves so that current pipe temperatures of the respective indoor heat exchangers reach corresponding target pipe temperatures, wherein the target pipe temperatures of the plurality of indoor heat exchangers are stored in a memory of the air conditioner.

6. The method of claim 5, wherein determining the target pipe temperatures comprises adding or subtracting a temperature value, corresponding to the difference between the set temperature and the sensed indoor temperature, from a mean value of pipe outlet temperatures of the plurality of indoor heat exchangers.

7. The method of claim 6, wherein, when the sensed indoor temperature is less than the set temperature, the expansion valve is adjusted so that the pipe outlet temperature of the indoor heat exchanger is greater than the mean value of the pipe outlet temperatures.

8. The method of claim 6, wherein, when the sensed indoor temperature is greater than the set temperature, the expansion valve is adjusted so that the pipe outlet temperature of the indoor heat exchanger is lower than the mean value of the pipe outlet temperatures.

9. A method of controlling an air conditioner, the method comprising:

performing a heating or cooling operation with a plurality of indoor units;

sensing indoor temperatures of a plurality of rooms respectively connected to the plurality of indoor units;

determining differences between the sensed indoor temperatures and respective set temperatures of the plurality of rooms, and determining amounts of opening variation of a plurality of expansion valves respectively provided with the plurality of indoor units based on the determined differences; and adjusting openings of the expansion valves corresponding to the determined amounts of opening variation to adjust a flow rate therethrough, wherein determining the target pipe temperatures comprises adding or subtracting a temperature value, corresponding to the difference between the set temperature and the sensed indoor temperature, from a mean value of pipe outlet temperatures of the plurality of indoor heat exchangers.

* * * * *